US007361889B2

(12) United States Patent
Yamaguchi

(10) Patent No.: US 7,361,889 B2
(45) Date of Patent: Apr. 22, 2008

(54) TIME OF FLIGHT MASS SPECTROMETER

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 242 days.

(21) Appl. No.: 11/390,109

(22) Filed: Mar. 28, 2006

(65) Prior Publication Data

US 2006/0219890 A1 Oct. 5, 2006

(30) Foreign Application Priority Data

Mar. 29, 2005 (JP) ..... 2005-095673

(51) Int. Cl.
*H01J 49/40* (2006.01)

(52) U.S. Cl. ..... 250/287

(58) Field of Classification Search ..... None
See application file for complete search history.

(56) References Cited

U.S. PATENT DOCUMENTS 6,300,625 B1 10/2001 Ishihara
6,906,321 B2 * 6/2005 Yamaguchi ..... 250/287
6,949,736 B2 * 9/2005 Ishihara ..... 250/282

FOREIGN PATENT DOCUMENTS

JP 11-135060 5/1999
JP 2006-12747 1/2006
JP 2006-012747 1/2006

* cited by examiner

*Primary Examiner*—Jack I. Berman
(74) *Attorney, Agent, or Firm*—Westerman, Hattori, Daniels & Adrian, LLP.

(57) ABSTRACT

The present invention relates to a time of flight mass spectrometer (TOFMS) having a flight space in which ions to be analyzed repeatedly fly in a loop orbit or reciprocal path. In an example of the present invention, the TOFMS carries out two rounds of measurement for one sample under two conditions differing in the effective flight distance of the ions to create two flight time spectrums. The data processor of the TOFMS compares the central points of the peaks in the two spectrums to identify peaks that have resulted from the same kind of ion (Step S3). If any peak is found to be unidentifiable ("No" in Step S4), the data processor examines the similarity of the peak shapes (e.g. half-value width) to identify peaks that have resulted from the same kind of ion (Step S5). After the correspondence of all the peaks have been determined, the data processor calculates the approximate mass to charge ratio of each ion from the difference in flight time (Step S6) and determines the number of turns of the ion based on the approximation (Step S7). Finally, it calculates the exact mass to charge ratio, using the number of turns and the flight time (Step S8). Thus, even if the sample contains many components and the spectrums accordingly have many peaks mixed together, the TOFMS can identify all the peaks.

13 Claims, 7 Drawing Sheets

TIME OF FLIGHT MASS SPECTROMETER

The present invention relates to a time of flight mass spectrometer. More specifically, it relates to a time of flight mass spectrometer having a flight space in which ions to be analyzed repeatedly fly in a substantially identical loop orbit or reciprocal path.

BACKGROUND OF THE INVENTION

In a time of flight mass spectrometer (TOFMS), ions accelerated by an electric field are injected into a flight space where no electric field or magnetic field is present. The ions are separated by their mass to charge ratios according to the time of flight (or "flight time") until they reach a detector and are detected thereby. Since the difference in the flight time of two ions having different mass to charge ratios is larger as the flight path is longer, it is preferable to design the flight path as long as possible in order to enhance the resolution in the mass to charge ratio of the TOF-MS. In many cases, however, it is difficult to incorporate a long straight path in a TOF-MS due to the limited overall size, so that various measures have been taken to effectively lengthen the flight length.

For example, the TOFMS disclosed in the Japanese Unexamined Patent Publication No. H11-135060 (Patent Document 1) includes a closed, "8" shaped loop orbit, where the ions are guided to fly repeatedly in the "8" shaped orbit many times so that the effective flight length is elongated. However, in general, TOFMSs using any type of loop orbit (including the "8" shaped one) has a problem, as explained below with reference to FIG. 2, which shows the schematic construction of a TOFMS having a simple, circular loop orbit instead of the "8" shaped one.

Starting from the ion source 1, the ions are introduced through the gate electrode 4 into the flight space 2 and then guided into the circular loop orbit 3 formed within the flight space 2. It should be noted that FIG. 2 omits the electrodes that generate electric fields for keeping the ions flying in the loop orbit 3. After flying in the loop orbit 3 once or a repeated number of times, the ions leave the loop orbit 3 immediately after they pass through the gate electrode 4. Then, they exit the flight space 2 and reach the detector 5 outside the flight space 2. In this process, the flight distance of the ions increases as the number of turns of the ions in the loop orbit 3 becomes larger, and the increase in the flight distance produces a larger difference between the flight times of two ions having close mass to charge ratios and thereby facilitates the separation of the two ions. One problem for this process is that an ion having a smaller mass to charge ratio will fly in the loop orbit 3 at a higher speed and can catch up with another ion having a larger mass to charge ratio while flying in the loop orbit 3 several times. If this happens, the two kinds of ions will simultaneously leave the loop orbit 3 and reach the detector 5 at approximately the same time.

In summary, the above-described type of TOFMS can effectively separate ions having close mass to charge ratios but may face difficulty in separating ions whose mass to charge ratios differ from each other so that an ion having a small mass to charge ratio can catch up with or lap another ion having a larger mass to charge ratio during their flight. This problem is not unique to the construction in which the ions repeatedly fly in a loop orbit in one direction. For example, the same problem can also occur in the case where the ions are made to reciprocally fly in a straight or curved path so as to achieve a long flight distance by increasing the number of reciprocating motions of the ions.

To avoid the above-described problem, the present inventor has proposed a new method in the Japanese Unexamined Patent Publication No. 2006-12747 (Patent Document 2). According to the method, the flight time of an ion having a specific mass to charge ratio is measured either on the injection path along which the ions that have left the ion source 1 travel until they enter the loop orbit 3, or on the ejection path along which the ions that have left the loop orbit 3 after making a predetermined number of turns in the loop orbit 3 travel until they reach the detector 5, under two conditions differing in the effective flight distance of the path concerned. Since the difference in the flight time between the two measurements depends on the mass to charge ratio, it is possible to calculate the mass to charge ratio from the flight time difference. Patent Document 2 also states that, instead of varying the effective flight distance, it is also possible to vary the state of a certain field (e.g. an electric field) that applies a certain force on the ion flying through a predetermined section of the injection or ejection path. This method changes the time required for the ion having a specific mass to charge ratio to pass through the field, thereby causing a difference in the flight time of the ion.

In these methods, approximate mass to charge ratios can be calculated from the flight time difference. These approximate values can be used to distinguish the peaks resulting from plural ions having different mass to charge ratios, determine the numbers of turns, and calculate the exact mass to charge ratios, even if an ion has caught up with or lapped another ion while flying in the loop orbit.

In the above-described methods, a flight time spectrum with the flight time as the abscissa and the signal strength as the ordinate is created for each of the two measurement conditions established by changing the flight distance or the force acting on the ions, and the resulting two spectrums are compared with each other to determine which peak in one spectrum corresponds to which peak in the other. However, if the sample to be analyzed contains many components, the spectrums will have a number of peaks and it will be difficult to determine the correspondence of the peaks. The lack of information about the peak correspondence makes it impossible to calculate the flight time difference and determine the number of turns of each ion corresponding to each peak. Thus, it will be impossible to calculate the exact mass to charge ratios.

To solve the problems described thus far, the present invention provides a time of flight mass spectrometer having a loop orbit or a similar path, which is capable of accurately determining the number of turns of each ion that forms a peak in the flight time spectrum and exactly determining the mass to charge ratio of each ion even if the sample to be analyzed contains many components.

SUMMARY OF THE INVENTION

Thus, in a time of flight mass spectrometer for separately detecting different kinds of ions with respect to their mass to charge ratios by releasing the ions from an ion source, making them fly substantially along a substantially identical track once or multiple times repeatedly, and then introducing them into a detector, the time of flight mass spectrometer according to the first mode of the present invention includes:

a) a measuring system for measuring the flight time of the ions under at least two conditions differing in the effective flight distance between the point where the ions leave the ion source and the point where the ions enter the track or between the point where the ions leave the track and the point where the ions reach the detector, or in the state of a force acting within a field for accelerating or decelerating the ions traveling through the field;

b) a peak identifier for comparing the shapes of peaks in at least two flight time spectrums obtained through the measurements with the measuring system and for identifying peaks resulting from the same kind of ion; and c) a processor for calculating the difference in the flight time between peaks that the peak identifier has identified as resulting from the same kind of ion, and for estimating the mass to charge ratio of an ion from the difference in the flight time.

Also, in a time of flight mass spectrometer for separately detecting different kinds of ions with respect to their mass to charge ratios by releasing the ions from an ion source, making them fly substantially along the same track once or multiple times repeatedly, and then introducing them into a detector, the time of flight mass spectrometer according to the second mode of the present invention includes:

a) a measuring system for measuring the flight time of the ions under three conditions differing in the effective flight distance between the point where the ions leave the ion source and the point where the ions enter the track or between the point where the ions leave the track and the point where the ions reach the detector, or in the state of a force acting within a field for accelerating or decelerating the ions traveling through the field;

b) a peak identifier for locating peaks resulting from the same kind of ion by selecting two peaks on the supposition that they have resulted from the same kind of ion among all peaks in two of three flight time spectrums created from measurement data obtained with the measuring system, predicting the position at which another peak resulting from the same kind of ion should exist on the other flight time spectrum if the aforementioned supposition is correct, and determining whether a peak actually exists at the predicted position; and c) a processor for calculating the difference in the flight time between peaks that the peak identifier has identified as resulting from the same kind of ion, and for estimating the mass to charge ratio of the ion from the difference in the flight time.

In the time of flight mass spectrometers according to the first and second modes of the present invention, the "track" does not always need to be perfectly identical throughout the multiple turns. For example, it may slightly shift at every turn of the ion to form a spiral path. It may also be a straight or curved reciprocal path through which the ions travel back and forth.

In the time of flight mass spectrometers according to the first and second modes of the present invention, if the sample to be analyzed contains many components, the flight time spectrum will have several peaks resulting from ions having different numbers of turns. Therefore, comparing the central points of the peaks (i.e. the point in time at which the top of the peak is located) present on two flight time spectrums obtained under different measurement conditions does not always determine the correspondence of the peaks.

To address such a problem, the time of flight mass spectrometer according to the first mode of the present invention identifies peaks resulting from the same kind of ion by examining the shapes of the peaks, such as the width (i.e. half-value width) or strength of the peak, the isotope distribution or other information. In general, this type of mass spectrometer is designed to guarantee the time-focusing of ions so that ions having the same mass to charge ratio and being simultaneously released from the ions source will reach the detector at the same time, where the dispersion in the detection time changes with the mass to charge ratio. This means that the peak width depends on the mass to charge ratio. Therefore, if two peaks have similar shapes, it is highly probable that they have resulted from the ions having the same mass to charge ratio.

Even if the sample contains many components, the time of flight mass spectrometer according to the first mode of the present invention needs to measure the sample no more than twice to approximately calculate the mass to charge ratio of the ion of each component, determine the number of turns of each ion from the approximate values, and then calculate the exact mass to charge ratio. Thus, the mass analysis of the ions can be efficiently performed over a broad range of mass to charge ratios.

The time of flight mass spectrometer according to the second mode of the present invention measures each sample three times and analyzes the resulting three flight time spectrums to identify the peaks resulting from the same kind of ion. Though the number of measurements performed for each sample is larger than in the case of the first mode, the present mass spectrometer can determine the peaks resulting from the same kind of ion with higher reliability and thereby improve the accuracy of mass analysis.

DETAILED DESCRIPTION OF PREFERRED EMBODIMENTS

Embodiment 1

Figure 1:
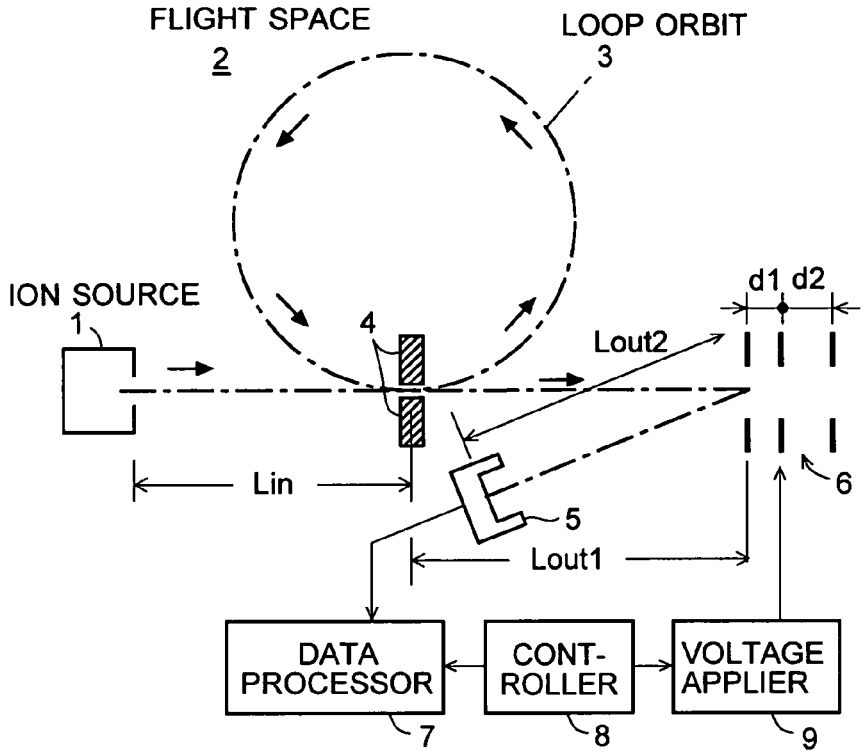
FIG. 1 is a schematic diagram of a TOFMS as an embodiment (Embodiment 1) of the present invention.
Figure 2:
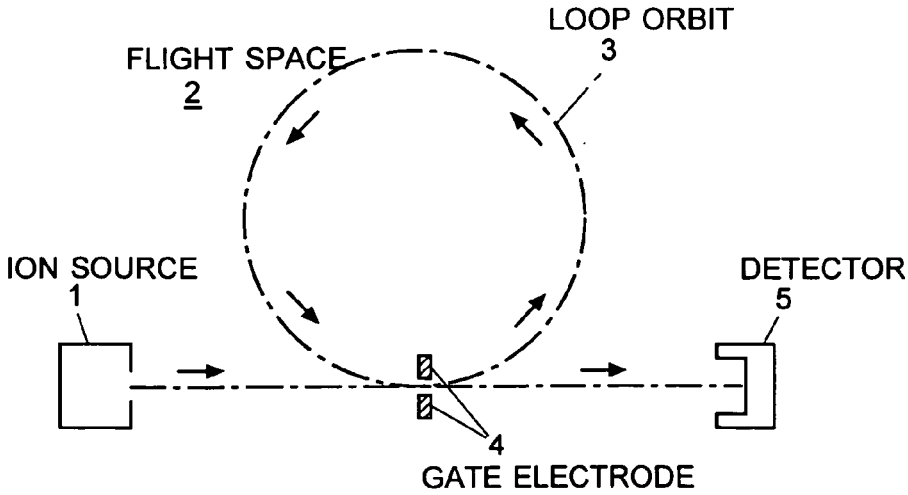
Fig. 2 PRIOR ART
FIG. 2 is a schematic diagram of a conventional TOFMS.

An embodiment (Embodiment 1) of the time of flight mass spectrometer according to the present invention is described with reference to the attached drawings. FIG. 1 is a schematic diagram of the TOFMS of the present embodiment. It should be noted that those components which are identical or corresponding to some components shown in FIG. 2 are denoted by the same numerals.

In FIG. 1, various kinds of ions extracted from the ion source 1 are injected through the gate electrode 4 into the loop orbit 3 in the flight space 2. Then, after flying in the loop orbit 3 once or multiple times, the ions leave the loop orbit 3 and are ejected from the flight space 2 immediately after they pass through the gate electrode 4. Outside the exit of the flight space 2, a reflector 6 consisting of reflecting electrodes is located for generating an electric field, which repels the ions toward the detector 5. Under the command of the controller 8, the voltage applier 9 varies the voltage applied to the reflector 6 so as to appropriately change the potential gradient of the electric field within the reflector 6. A change in the potential gradient leads to a shift in the point at which ions of the same kind turn around within the reflector 6. Thus, the effective distance of the ejection path is changed as desired.

Referring to FIG. 1, the following description uses the following parameters:

Lin: flight distance between ion source 1 and gate electrode 4 (called the "injection flight distance" hereinafter)

Ct: circumferential length of loop orbit 3

Lout1: flight distance between gate electrode 4 and reflector 6 (called the "first section of the ejection flight distance" hereinafter)

Lout2: flight distance between reflector 6 and detector 5 (called the "second section of the ejection flight distance" hereinafter)

d1: field space of first stage of reflector 6 d2: field space of second stage of reflector 6

V1: voltage applied to first stage of reflector 6

V2: voltage applied to second stage of reflector 6 t1: time required for ions having an atomic mass unit of 100 to make a single turn in the loop orbit t2: lapse of time from the point where ions are released from ion source 1 to the point where a voltage for releasing the ions toward reflector 6 is applied to gate electrode 4 m: mass to charge ratio of ion

U: kinetic energy of ion accelerated by ion source 1

The following description assumes the following parametric setting: Lin=0.25 [m], Ct=2 [m], Lout1=0.25 [m], Lout2=0.5 [m], d1=0.008 [m], d2=0.06 [m], V1=2100 [V], V2=1350 [V], t2=500 [μs] and U=3000 [eV].

In the present example, the operational steps are as follows:

(1) At time=0, the ions accelerated by the ion source 1 start their flight. After traveling through the injection flight path, they enter the loop orbit 3.

(2) When the ion having an atomic mass unit of 100 has made a single turn in the loop orbit 3, the electric field generated by the voltage applied to the gate electrode 4 is switched from the first state where the ions coming through the injection flight path are guided into the loop orbit 3 to the second state where the ions that have entered the loop orbit 3 are made to keep flying in the loop orbit 3.

(3) At time=t2 (500 μs), the electric field generated by the voltage applied to the gate electrode 4 is switched from the previous state to the third state where the ions that are flying through the loop orbit 3 are released from the loop orbit 3 and travel through the ejection path toward the reflector 6.

Figure 3:
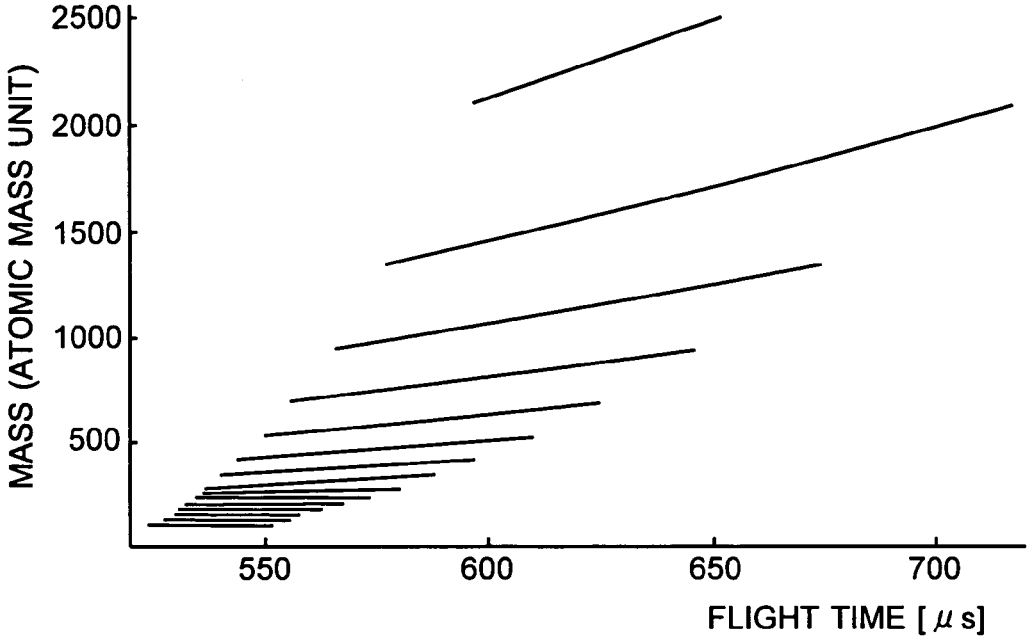
FIG. 3 is a graph showing the relationship between the mass to charge ratio and the flight time of the ions within the range from 100 to 2500 in mass to charge ratio.

In the present case, the relationship between the mass to charge ratio and the flight time for the ions having mass to charge ratios from 100 to 2500 will be as shown in FIG. 3. An ion having a smaller mass to charge ratio will fly at a higher speed and make a larger number of turns in the loop orbit 3.

Figure 4:
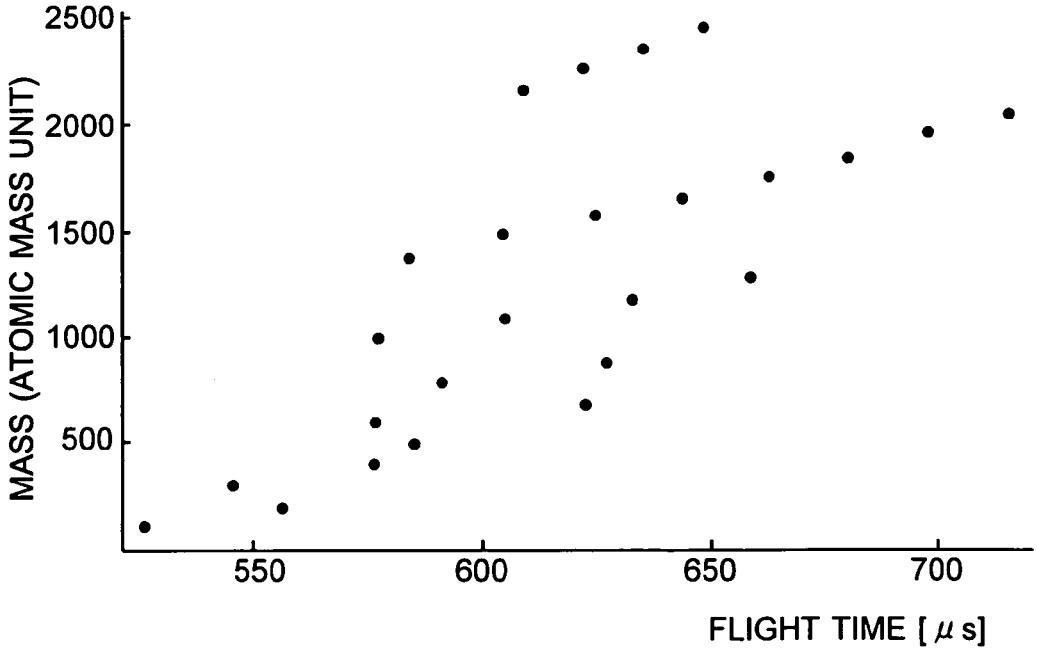
FIG. 4 is a graph showing the relationship between the mass to charge ratio and the flight time of ions, where the ions are observed at intervals of 100 in atomic mass unit within the range shown in FIG. 3.
Figure 5:
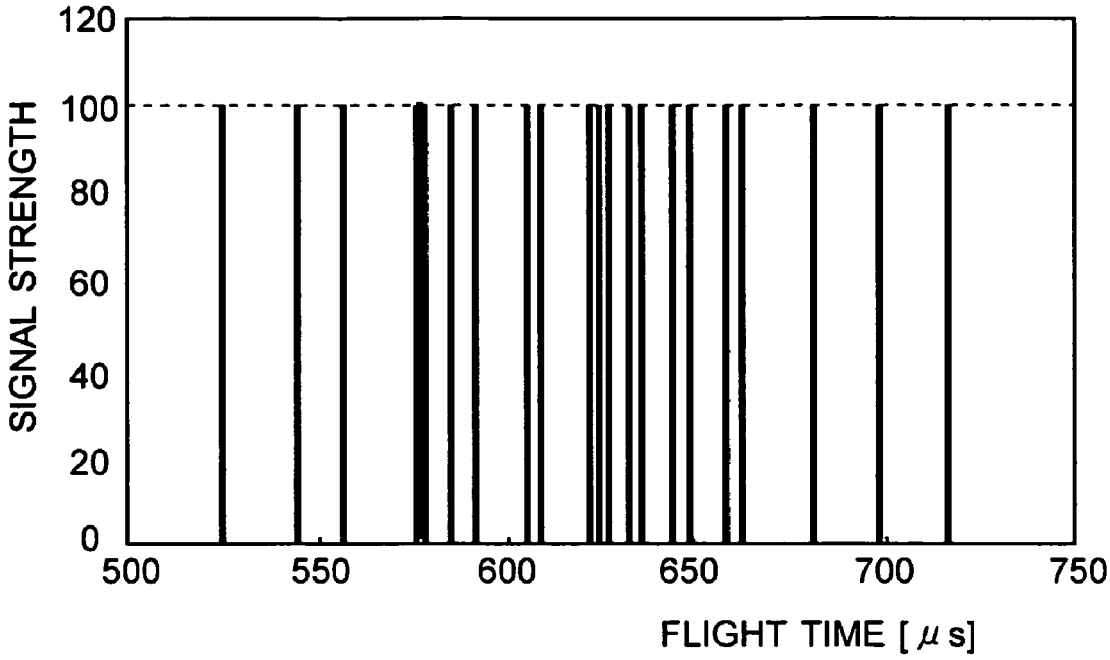
FIG. 5 is a flight time spectrum corresponding to FIG. 4, obtained under the condition that the ions are identical in signal strength.

Suppose that ions are observed only at intervals of 100 in atomic mass unit. Then, the graph will be as shown in FIG. 4, in which only specific points on the curves shown in FIG. 3 are plotted. It should be noted that the mass to charge ratios of the ions are unknown at the detector 5. Therefore, on the assumption that the signal strength is uniform, the resulting flight time spectrum will be as shown in FIG. 5. In this spectrum, a number of peaks of the ions that have made a different number of turns are mixed together, and it is impossible to determine which peak corresponds to an ion that has made what number of turns.

Figure 6A:
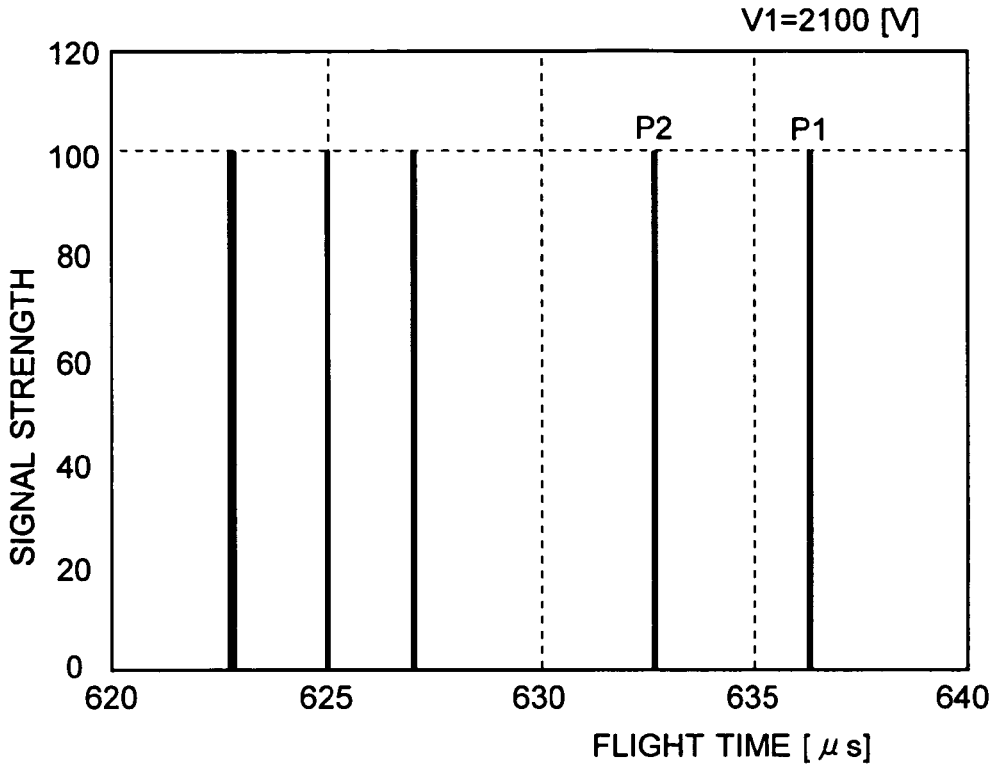
FIGS. 6A and 6B are examples of flight time spectrums obtained by the two rounds of measurement over the range from 620 to 640 μs in flight time.
Figure 6B:
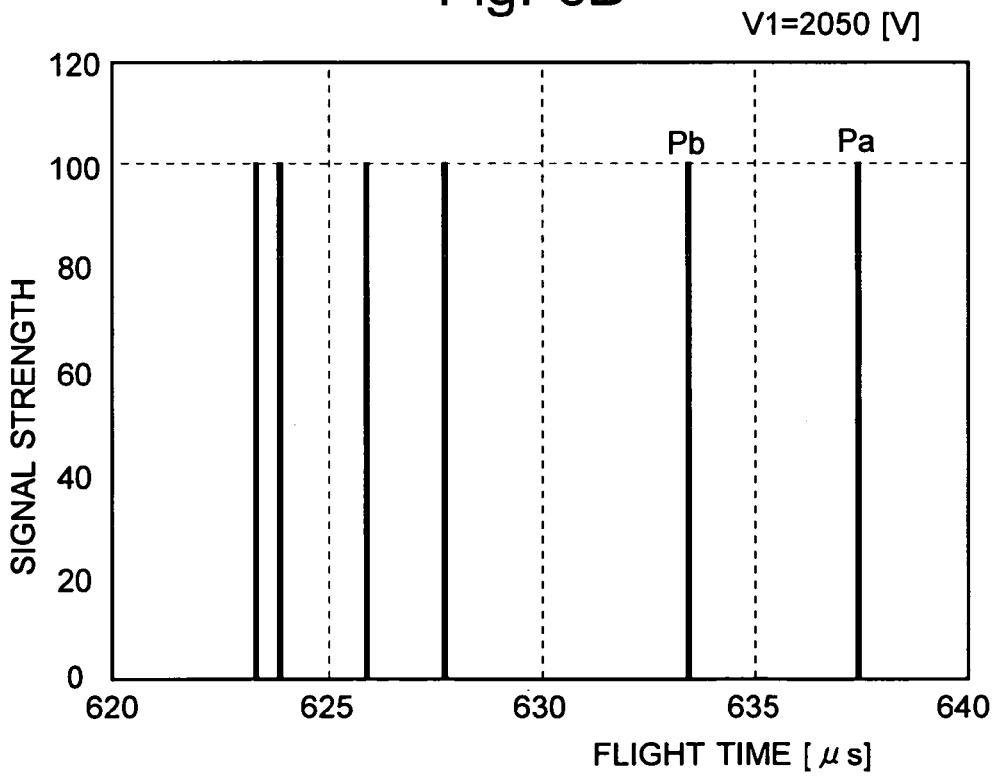

To simplify the explanation, the following description focuses on the range from 620 to 640 μs in flight time. FIG. 6A shows the spectrum within the range from 620 to 640 μs for V1=2100 [V]. Starting from this state, the voltage V1 applied to the first stage of the reflector 6 is lowered to 2050 [V] to perform the second round of the measurement. The decrease in voltage V1 will allow the ions to go deeper into the reflector 6 and thereby make the ejection path longer, so that the flight time will be longer. FIG. 6B shows the spectrum within the range from 620 to 640 μs for V1=2050 [V]. As in the present case, if there are many spectrums (i.e. if many components are simultaneously analyzed), the correspondence of the peaks between FIG. 6A and FIG. 6B becomes unclear.

For example, it is easy to determine that the two peaks P2 and P1 located close to 633 μs and 636 μs in FIG. 6A correspond to the two peaks Pb and Pa located close to 633.5 μs and 637 μs in FIG. 6B. However, it is difficult to determine which of the two adjacent peaks located close to 623 μs in FIG. 6A corresponds to which peak in FIG. 6B.

To address this problem, the TOFMS in the present embodiment uses information about the shapes of the peaks when the central points of the peaks do not provide a reliable basis for determining which peaks have resulted from the same kind of ion. Examples of the peak shape information include the half-value width or the strength of each peak, and the distribution of isotopes having different compositions. In principle, the half-value width of a peak depends on the mass to charge ratio. Therefore, it is possible to identify peaks resulting from the same ion by comparing the two flight time spectrums obtained through the first round of the measurement with V1=2100 [V] and the second round with V1=2050 [V] and searching for peaks having similar shapes.

Figure 7:
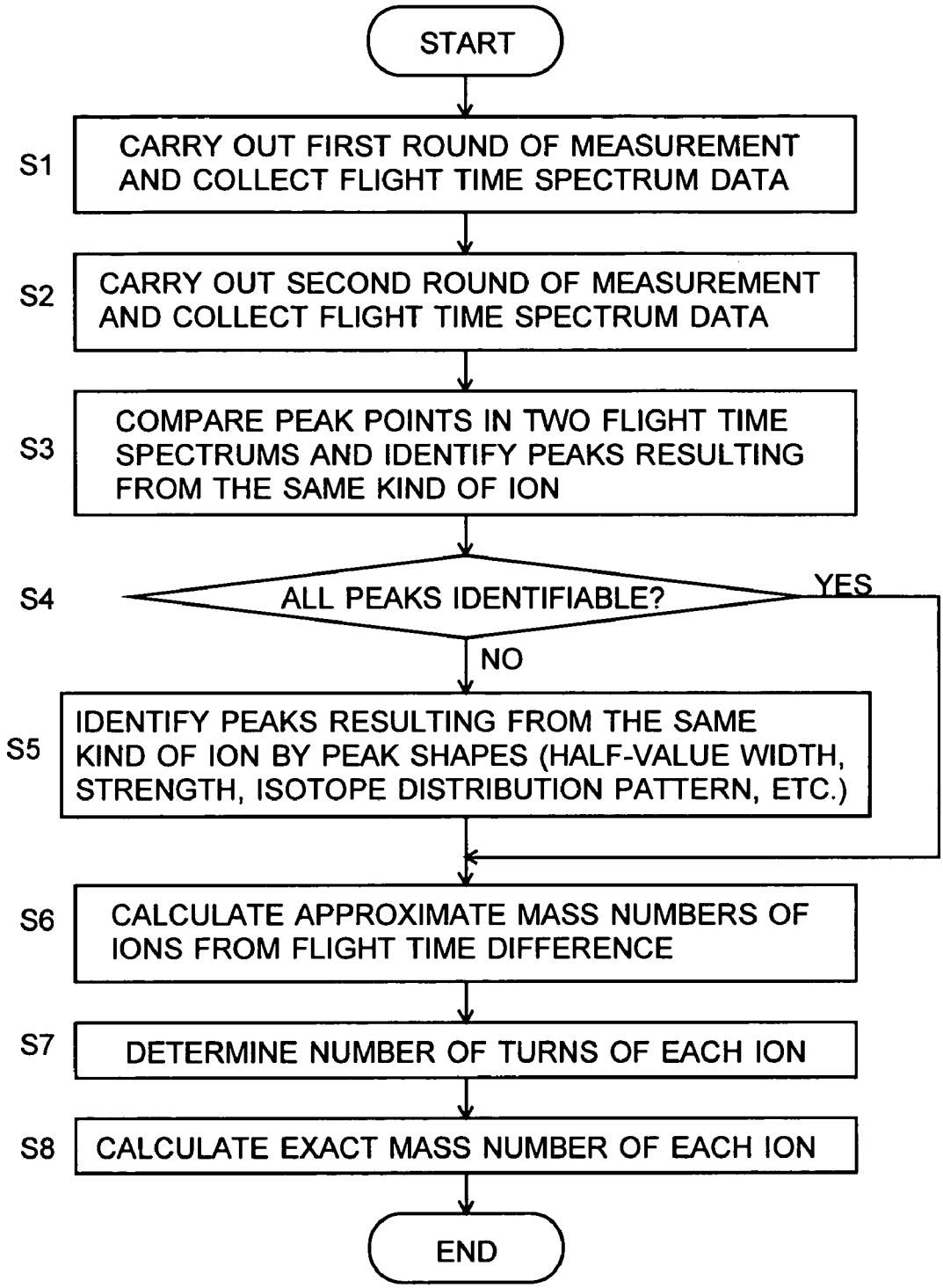
FIG. 7 is a flow chart showing the analysis steps of the TOFMS in the first embodiment.

The steps of the analysis carried out by the TOFMS in the present embodiment are described with reference to the flow chart shown in FIG. 7. First, as described previously, the voltage V1 applied to the first stage of the reflector 6 is set at a predetermined level (2100 [V] in the previous example), and the first round of the measurement is carried out to collect a set of flight time spectrum data (Step S1). This set of data is used to construct a (first) flight time spectrum, as shown in FIG. 6A. Next, the voltage V1 applied to the first stage of the reflector 6 is changed to a new level (2050 [V] in the previous example), and the second round of the measurement is carried out to collect another set of flight time spectrum data (Step S2). This set of data is used to construct another (second) flight time spectrum, as shown in FIG. 6B.

The data processor 7, which functions as the peak identifier and the processor of the present invention, compares the central points of the peaks present on the two flight time spectrums and attempts to identify a pair of peaks resulting from the same kind of ion (Step S3). For example, it defines a certain period of delay time for each peak in the first flight time spectrum and then checks whether any peak in the second flight time spectrum is within the aforementioned delay time. If there is only one peak located within the delay time, the data processor 7 identifies the two peaks in the first and second spectrums as resulting from the same kind of ion. In contrast, if more than one peak is located within the delay time on the second flight time spectrum, the data processor 7 concludes that it is impossible to identify a peak in the second spectrum that has resulted from the same kind of ion as the peak concerned in the first spectrum. The delay time can be defined with respect to the difference in the flight time of the ion having the largest mass to charge ratio between the first and second rounds of the measurement carried out under different conditions.

Then, the operation proceeds to Step S6 if all the peaks have been successfully identified ("Yes" in Step S4) or to Step S5 if there is any peak remaining unidentified ("No" in Step S4). In Step S5, the data processor 7 searches the second flight time spectrum for a peak whose shape is similar to that of each peak in the first flight time spectrum, as described earlier. Practically, there is no need to check all the peaks in the second spectrum; for a given peak in the first spectrum, it is necessary to only check the peaks located within the delay time in the second spectrum. The similarity of the shapes between two peaks can be determined by comparing their half-value widths. Alternatively, it is possible to compare the signal strengths of the peaks; the strengths of two peaks resulting from the same kind of ion should be approximately equal as long as the interval of the two rounds of the measurement is short. An isotope distribution pattern is also useful if the ion concerned has one or more isotopes. The techniques described thus far make it possible to determine the correspondence of the peaks even if there are many peaks as shown in FIGS. 6A and 6B.

After determining the correspondence of the peaks of the two flight time spectrums by Steps S3 to S5, the data processor 7 calculates the approximate mass to charge ratio of each ion from its flight time difference (Step S6) and determines the number of turns of the ion from the approximate mass to charge ratio (Step S7). With the number of turns thus determined, the data processor 7 recalculates the exact mass to charge ratio of each ion on the basis of the flight time calculated using the number of turns. Thus, the mass to charge ratio of each ion contained in the sample is accurately determined.

Embodiment 2

Figure 8:
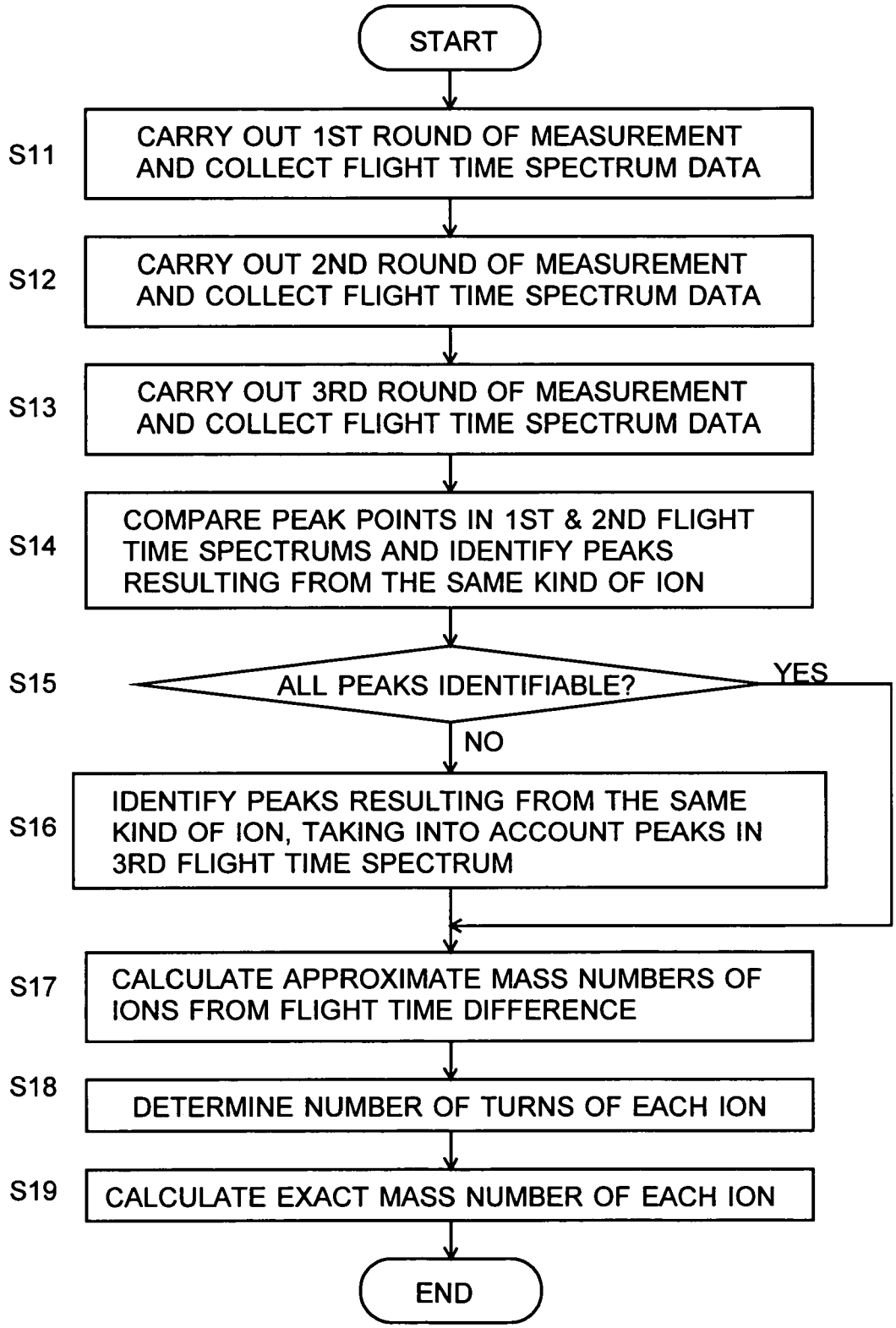
FIG. 8 is a flow chart showing the analysis steps of a TOFMS in another (second) embodiment of the present invention.

Another embodiment (Embodiment 2) of the time of flight mass spectrometer according to the present invention is hereby described. The difference between Embodiment 1 and Embodiment 2 exists in the steps of the analysis carried out by the TOFMS. The following description explains this difference, referring to the flow chart shown in FIG. 8.

First, as described previously, the voltage V1 applied to the first stage of the reflector 6 is set at a predetermined level (e.g. 2100 [V]), and the first round of the measurement is carried out to collect a first set of flight time data (Step S11). Next, the voltage V1 applied to the first stage of the reflector 6 is changed to a new level (e.g. 2050 [V]), and the second round of the measurement is carried out to collect a second set of flight time data (Step S12). Subsequently, the voltage V1 applied to the first stage of the reflector 6 is again changed to a new level (e.g. 2000 [V]), and the third round of the measurement is carried out to collect a third set of flight time data (Step S13). The three sets of the data are used to construct the first, second and third flight time spectrums, respectively.

Then, the data processor 7 compares the central points of the peaks present on the first and second flight time spectrums and attempts to identify a pair of peaks resulting from the same kind of ion (Step S14). The method for comparing peaks is the same as in Embodiment 1: the data processor 7 defines a certain period of delay time for each peak in the first flight time spectrum and then checks whether any peak in the second flight time spectrum is within the delay time. If there is only one peak within the delay time, the data processor 7 identifies the two peaks in the first and second spectrums as resulting from the same kind of ion. In contrast, if more than one peak is located within the delay time on the second flight time spectrum, the data processor 7 concludes that it is impossible to identify a peak in the second spectrum that has resulted from the same kind of ion as the peak concerned in the first spectrum.

Then, the operation proceeds to Step S17 if all the peaks have been successfully identified ("Yes" in Step S15) or to Step S16 if there is any peak remaining unidentified ("No" in Step S15). In Step S16, the central points of the peaks in the third flight time spectrum are also taken into account in addition to the peaks in the first and second flight time spectrums. More specifically, for each peak in the first flight time spectrum, the data processor 7 designates one peak within the delay time, assuming that this peak corresponds to the aforementioned peak in the first flight time spectrum. Then, on this assumption, it predicts the position at which another corresponding peak should exist in the third flight time spectrum. If a peak is actually located at the predicted position in the third spectrum, the data processor 7 concludes that the above assumption concerning the second flight time spectrum is correct.

Figure 9:
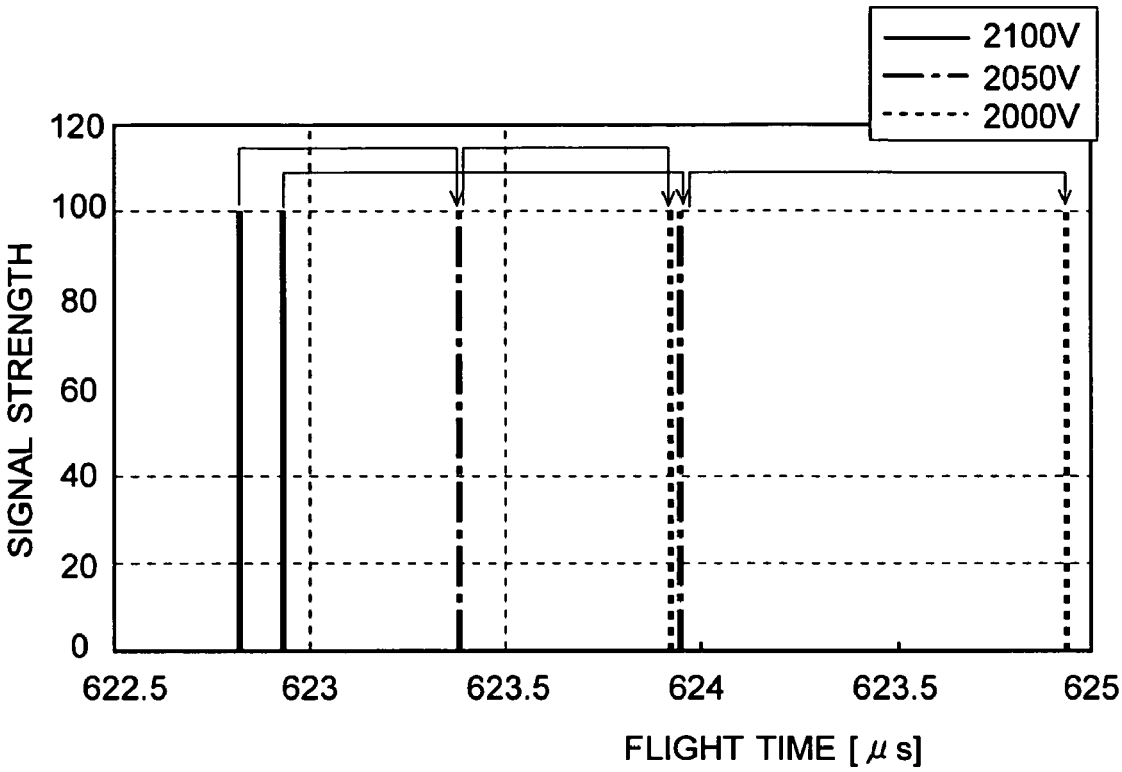
FIG. 9 is an example of three flight time spectrums obtained by three rounds of measurement.

For example, the flight time spectrum shown in FIG. 9 demonstrates that the distance between two peaks, which is relatively small in the first round of the measurement (V1=2100 [V]), becomes longer in the subsequent rounds as the ejection distance is increased by changing the voltage V1 from 2100 [V] to 2050 [V], and then to 2000 [V]. Thus, the additional use of the third flight time spectrum makes it possible to easily identify the peaks even if the information obtained through the first and second rounds of the measurement is insufficient.

It should be noted that the embodiments described thus far are mere examples of the present invention and they can be changed, modified or expanded within the spirit and scope of the present invention. For example, it is possible to use a different method for changing the flight distance in place of the one described in the embodiments in which the effective flight distance of ions was changed by switching the voltage applied to the reflector located on the ejection path along which the ions released from the loop orbit travel to the detector. Also, instead of changing the flight distance, it is possible to produce the difference in the flight time by changing the degree of acceleration or deceleration of the ion by changing the state of an electric field through which the ions pass. The present invention can be applied to any of the various forms of time of flight mass spectrometers proposed in Patent Document 2.

What is claimed is:

1. A time of flight mass spectrometer for separately detecting different kinds of ions with respect to their mass to charge ratios by releasing the ions from an ion source, making them fly substantially along the same track once or multiple times repeatedly, and then introducing them into a detector, comprising:

a) a measuring system for measuring flight times of the ions under at least two conditions differing in an effective flight distance between a point where the ions leave the ion source and a point where the ions enter the track or between a point where the ions leave the track and a point where the ions reach the detector, or differing in a state of a force acting within a field for accelerating or decelerating the ions traveling through the field;

b) a peak identifier for comparing shapes of peaks in at least two flight time spectrums obtained through measurements with the measuring system and for identifying peaks resulting from the same kind of ion; and c) a processor for calculating a difference in the flight time between peaks that the peak identifier has identified as resulting from the same kind of ion, and for estimating the mass to charge ratio of an ion from the difference in the flight time.

2. The time of flight mass spectrometer according to claim 1, wherein the peak identifier compares half-value widths of the peaks.

3. The time of flight mass spectrometer according to claim 1, wherein the peak identifier compares strengths of the peaks.

4. The time of flight mass spectrometer according to claim 1, wherein the peak identifier compares isotope distributions of the peaks.

5. The time of flight mass spectrometer according to claim 1, wherein the measuring system includes an electric field generator for changing the effective flight distance between the two points concerned by changing a voltage applied to one or more electrodes of the electric field generator.

6. The time of flight mass spectrometer according to claim 1, wherein the peak identifier uses two flight time spectrums to identify the peaks resulting from the same kind of ion.

7. The time of flight mass spectrometer according to claim 6, wherein the peak identifier defines a certain period of delay time for each peak in one of the flight time spectrums and then checks whether any peak in the other flight time spectrum is within the aforementioned delay time.

8. The time of flight mass spectrometer according to claim 7, wherein, if there is only one peak located within the delay time, the peak identifier determines that the two peaks in the first and second spectrums have resulted from the same kind of ion.

9. The time of flight mass spectrometer according to claim 7, wherein the peak identifier defines the delay time with respect to the difference in the flight time of an ion having a largest mass to charge ratio between first and second rounds of the measurement carried out by the measuring system under different conditions.

10. A time of flight mass spectrometer for separately detecting different kinds of ions with respect to their mass to charge ratios by releasing the ions from an ion source, making them fly substantially along the same track once or multiple times repeatedly, and then introducing them into a detector, comprising:

a) a measuring system for measuring flight times of the ions under three conditions differing in the effective flight distance between a point where the ions leave the ion source and a point where the ions enter the track or between a point where the ions leave the track and a point where the ions reach the detector, or differing in a state of a force acting within a field for accelerating or decelerating the ions traveling through the field;

b) a peak identifier for locating peaks resulting from the same kind of ion by selecting two peaks on a supposition that they have resulted from the same kind of ion among all peaks in two of three flight time spectrums created from measurement data obtained with the measuring system, predicting a position at which another peak resulting from the same kind of ion should exist on the other flight time spectrum if the aforementioned supposition is correct, and determining whether a peak actually exists at the predicted position; and c) a processor for calculating a difference in the flight time between peaks that the peak identifier has identified as resulting from the same kind of ion, and for estimating the mass to charge ratio of the ion from the difference in the flight time.

11. The time of flight mass spectrometer according to claim 10, wherein the peak identifier defines a certain period of delay time for each peak in a first flight time spectrum and then checks whether any peak in a second flight time spectrum is within the aforementioned delay time.

12. The time of flight mass spectrometer according to claim 11, wherein, if there is only one peak located within the delay time, the peak identifier determines that the two peaks in the first and second spectrums have resulted from the same kind of ion.

13. The time of flight mass spectrometer according to claim 11, wherein the peak identifier defines the delay time with respect to the difference in the flight time of an ion having a largest mass to charge ratio between first and second rounds of the measurement carried out by the measuring system under different conditions.

* * * * *